US005720784A

United States Patent [19]

Killick et al.

[11] Patent Number: 5,720,784

[45] Date of Patent: Feb. 24, 1998

[54] FUEL BLENDS

[75] Inventors: Robert William Killick, Victoria; Lawrence Harold Parnaby; Peter Ronald Wrigley, both of South Victoria, all of Australia

[73] Assignee: Victorian Chemical International Pty. Ltd., Victoria, Australia

[21] Appl. No.: 586,886

[22] Filed: Jan. 26, 1996

[30] Foreign Application Priority Data

Jul. 26, 1993 [AU] Australia ..... PM0146

[51] Int. Cl.[6] ..... C01L 11/18

[52] U.S. Cl. ..... 44/451; 144/452

[58] Field of Search ..... 44/451, 452

[56] References Cited

U.S. PATENT DOCUMENTS

| | | | |
|---|---|---|---|
| 3,817,720 | 6/1974 | Moy et al. . | |
| 4,248,182 | 2/1981 | Malec et al. . | |
| 4,539,014 | 9/1985 | Sweeney | 44/457 |
| 4,753,661 | 6/1988 | Nelson et al. . | |

FOREIGN PATENT DOCUMENTS

| | | |
|---|---|---|
| 17816 | 8/1983 | Australia . |
| 22217 | 12/1983 | Australia . |
| 0319060 | 6/1989 | European Pat. Off. . |
| 2949118 | 12/1979 | Germany . |
| 2949535 | 12/1979 | Germany . |
| 2090612 | 7/1980 | United Kingdom . |
| 2090613 | 7/1982 | United Kingdom . |
| 9324593 | 12/1993 | WIPO . |

*Primary Examiner*—Jacqueline V. Howard
*Attorney, Agent, or Firm*—Kuhn & Muller

[57] ABSTRACT

A miscible fuel blend composition consisting of a diesel fuel oil and a $C_3$ (excluding n-propanol) - $C_{22}$organic alcohol.

7 Claims, No Drawings

FUEL BLENDS

FIELD OF THE INVENTION

This invention relates to fuel blend compositions including a hydrocarbon liquid and one or more higher molecular weight organic alcohols.

BACKGROUND TO THE INVENTION

Diesel oil, due to its cost and availability, continues to be the backbone for industry around the world being the principal fuel for use in trucks, ships, trains, some cars and other automotive equipment and different stationary types of engines.

It is well recognised that the combustion of diesel fuel in engines can be hazardous to the environment. In particular, the partial combustion of diesel fuel to carbon, carbon monoxide and nitrogen oxides creates noxious black exhaust gases which are pollutants. This problem is particularly observable in trucks and other automotive vehicles where noxious black exhaust gases can be seen being released into the environment.

Attempts have been made over the years to address the environmental concerns associated with exhaust fumes from engines by using alcohols such as methanol (methyl alcohol) or ethanol (ethyl alcohol) as fuels. Such attempts, for instance, have established that 15% of ethanol and 85% diesel oil provides an acceptable burning capacity without the necessity of modifying existing diesel engines.

The problem with using ethanol or methanol as a fuel in conjunction with diesel oil is that ethanol or methanol are immiscible with diesel oil, that is, they cannot be uniformly mixed or blended into one phase without rapid separation into their component parts. Since they cannot be uniformly mixed into one phase and stored for easy use, the components must be mixed just prior to use by, for example, having independent fuel tanks with the components independently pumped and mixed just before the combined fuel is injected into the fuel chamber. Such a system is currently being used in the bus fleet of the Des Moines Transit Authority, Iowa, USA.

One attempt to address the problem of immiscibility was to form an emulsion of the diesel oil and ethanol using an emulsifier. An example of this is in Australian Patent No. 544,728 which discloses a composition having 84.5% diesel oil, 15% hydrated ethanol and 0.5% emulsifier. The emulsifier is of the styrene butadiene co-polymer type in admixture with a high molecular weight polyethylene glycol dissolved in xylene. This mixture can show both batch to batch variation and instability as the diesel and ethanol separate in the fuel tank.

An attempt has also been made to address the problem of immiscibility by forming a blend comprising a petroleum fuel, methanol and a higher alcohol having 10–16 carbon atoms as a solvent for the petroleum fuel and methanol. An example of this is disclosed in U.S. Pat. No. 4,527,995.

A further attempt to address the problem of immiscibility is disclosed in UK Patent Application No. GB 2,090,611 where combustible compositions are claimed containing gas oils, methanol and a fatty acid ester for use in diesel engines. The claimed combustible compositions comprise from 20% to 90% by volume of at least one gas oil, from 5% to 50% by volume of methanol and from 5% to 60% by volume of at least one ($C_1$–$C_3$) alkyl ester of a ($C_6$–$C_{22}$) saturated or unsaturated fatty acid. The specification states that in relation to agents that render methanol and gas oils compatible, reference may be made to alcohols heavier than methanol such as butanol, but such substances must be added in substantial portions and do not have any favourable effect on the cetane number of the fuel.

In subsequent investigations leading to the present invention, it has been found that a composition including a hydrocarbon liquid and a higher molecular weight $C_3$ (excluding n-propanol) - $C_{22}$ organic alcohol forms a single phase composition which is not prone to separation.

SUMMARY OF THE INVENTION

In a first embodiment of the invention, there is provided a fuel blend composition including a hydrocarbon liquid (as hereinafter defined) and a $C_3$(excluding n-propanol)-$C_{22}$ organic alcohol.

In this specification, the term higher molecular weight organic alcohol means any alcohol from 3 carbon atoms (excluding n-propanol) to 22 carbon atoms. Additionally, the term hydrocarbon liquid, as used in this specification, means diesel oil and gas oil and mixtures thereof.

In a preferred embodiment of the invention, the alcohol content of the fuel blend composition is up to 60% by volume of the total composition and preferably is between 10% and 20%.

The higher molecular weight organic alcohol is preferably selected from iso-propanol, butanol, iso-butanol, tert-butanol, 2 ethyl hexanol, iso-octanol, decanol and oleyl alcohol or mixtures thereof.

In another preferred embodiment, the fuel blend composition may additionally include an immiscible alcohol such as ethanol and/or n-propanol or a mixture having two or more of ethanol, n-propanol and methanol. The term immiscible alcohol, as used in this specification, means ethanol and/or n-propanol or a mixture having two or more of ethanol, n-propanol and methanol.

In another preferred embodiment of the invention, the immiscible alcohol is up to 20% by volume of the total composition and preferably between 10% and 15%, and the higher molecular weight organic alcohol is up to 20% by volume of the total composition and preferably up to 10% of the total composition.

In a preferred embodiment of the invention, the hydrocarbon liquid is at least 40% by volume of the total composition. In a further preferred embodiment, the hydrocarbon liquid is preferably up to 80% by volume of the total composition. In yet a further preferred embodiment, the hydrocarbon is up to 95% by volume of the total composition.

It has surprisingly been found that the higher molecular weight organic alcohol forms a single phase composition with the hydrocarbon liquid and the composition is not prone to separation. It has also been surprisingly found that the higher molecular weight organic alcohol will couple the immiscible alcohol with the hydrocarbon liquid to form a single phase.

According to a preferred embodiment of the invention, there is provided a process for producing a fuel blend composition including the steps of:

(a) adding the higher molecular weight organic alcohol to the hydrocarbon liquid and thereafter;

(b) blending the resultant mixture until a single phase has been formed.

In a further preferred embodiment of the invention, step (a) involves adding in any order the higher molecular weight organic alcohol and the immiscible alcohol to the hydrocarbon liquid.

According to a preferred embodiment of the invention, there is provided a fuel additive composition including the immiscible alcohol and the higher molecular weight alcohol in respective amounts ranging in a ratio of 0–25:1. Up to 60% by volume of the fuel additive composition is added to the hydrocarbon liquid to form a single phase composition.

In a further preferred embodiment of the invention, a process to produce a single phase fuel blend composition is provided by:

(a) adding the higher molecular weight organic alcohol and the immiscible alcohol to form the additive composition and thereafter;

(b) adding the mixture of (a) to the hydrocarbon liquid; and (c) mixing the resultant mixture until a single phase has been formed.

EXAMPLES

The diesel oil used in the examples is that purchased from pumps of major Australian oil companies such as Caltex Petroleum Pty Ltd. The ethanol (ethyl alcohol) and iso-propanol are commercially available materials obtained from the CSR Distilleries,. Yarraville, Victoria, Australia where the ethanol is known as Ethanol 100SG/F3 which contains 3% methanol. The oleyl alcohol was purchased from Henkel Australia and all other compounds used in the examples were purchased from ICI Australia Limited.

The invention is illustrated by the following non-limiting examples of Compositions.

The following is a non-limiting example of a process to produce Composition 1 below according to the invention.

Diesel oil (80 ml) is placed in a 100 ml bottle at ambient temperature and pressure. Ethanol (15 ml) and n-butanol (5 ml) are added to the bottle, a stopper applied to the top of the bottle and the resultant mixture is shaken for a period of approximately 30 seconds or such less or further period of time to allow proper mixing of the liquids to take place and a single phase to form. The mixture is then allowed to stand to allow the contents to settle. A single phase is observed.

Substantially the same method is used to produce the other compositions detailed below. Product blends were made (as percentage v/v) as follows.

| Composition 1 | |
|---|---|
| Diesel Oil | 80.0 |
| Ethanol | 15.0 |
| n-Butanol | 5.0 |
| | 100.0 |

| Composition 2 | |
|---|---|
| Diesel Oil | 50.0 |
| Iso-Butanol | 50.0 |
| | 100.0 |

| Composition 3 | |
|---|---|
| Diesel Oil | 85.0 |
| Iso-Propanol | 15.0 |
| | 100.0 |

| Composition 4 | |
|---|---|
| Gas Oil | 85.0 |
| Ethanol | 7.5 |
| Iso-Propanol | 7.5 |
| | 100.0 |

-continued

| Composition 5 | |
|---|---|
| Diesel Oil | 80.0 |
| Methanol | 1.5 |
| Ethanol | 13.5 |
| Iso-Butanol | 5.0 |
| | 100.0 |

| Composition 6 | |
|---|---|
| Diesel Oil | 80.0 |
| Ethanol | 15.0 |
| Iso-Octanol | 5.0 |
| | 100.0 |

| Composition 7 | |
|---|---|
| Diesel Oil | 75.0 |
| Ethanol | 20.0 |
| Oleyl Alcohol | 5.0 |
| | 100.0 |

| Composition 8 | |
|---|---|
| Diesel Oil | 40.0 |
| Gas Oil | 40.0 |
| n-Butanol | 20.0 |
| | 100.0 |

| Composition 9 | |
|---|---|
| Diesel Oil | 77.0 |
| Ethanol | 20.0 |
| Oleyl Alcohol | 3.0 |
| | 100.0 |

| Composition 10 | |
|---|---|
| Deisel Oil | 77.0 |
| Ethanol | 20.0 |
| 2 Ethyl Hexanol | 3.0 |
| | 100.0 |

| Composition 11 | |
|---|---|
| Diesel Oil | 94.0 |
| Ethanol | 5.0 |
| n-Butanol | 1.0 |
| | 100.0 |

| Composition 12 | |
|---|---|
| Diesel Oil | 76.0 |
| Ethanol | 20.0 |
| 2 Ethyl Hexanol | 4.0 |
| | 100.0 |

| Composition 13 | |
|---|---|
| Diesel Oil | 94.0 |
| Ethanol | 5.0 |
| Iso-Propanol | 1.0 |
| | 100.0 |

| Composition 14 | |
|---|---|
| Diesel Oil | 94.0 |
| Ethanol | 5.0 |
| 2 Ethyl Hexanol | 1.0 |
| | 100.0 |

| Composition 15 | |
|---|---|
| Diesel Oil | 94.8 |
| Ethanol | 5.0 |
| Decanol | 0.2 |
| | 100.0 |

-continued

| | |
|---|---|
| Composition 16 | |
| Diesel Oil | 77.0 |
| Ethanol | 20.0 |
| Decanol | 3.0 |
| | 100.0 |
| Composition 17 | |
| Diesel Oil | 94.0 |
| Ethanol | 5.0 |
| Oleyl Alcohol | 1.0 |
| | 100.0 |
| Composition 18 | |
| Diesel Oil | 70.0 |
| Ethanol | 20.0 |
| n-Butanol | 10.0 |
| | 100.0 |
| Composition 19 | |
| Diesel Oil | 65.0 |
| Ethanol | 20.0 |
| n-Butanol | 15.0 |
| | 100.0 |
| Composition 20 | |
| Diesel Oil | 75.0 |
| Ethanol | 20.0 |
| n-Butanol | 5.0 |
| | 100.0 |
| Composition 21 | |
| Diesel Oil | 90.0 |
| Oleyl Alcohol | 10.0 |
| | 100.0 |
| Composition 22 | |
| Diesel Oil | 90.0 |
| Ethanol | 5.0 |
| n-Butanol | 2.5 |
| Iso-Octanol | 2.5 |
| | 100.0 |
| Composition 23 | |
| Diesel Oil | 80.0 |
| Ethanol | 10.0 |
| n-Butanol | 10.0 |
| | 100.0 |

All of the above Compositions had a single phase demonstrating the effectiveness of the use of the higher molecular weight organic alcohol to blend with the hydrocarbon liquid or the use of a higher molecular weight organic alcohol and the immiscible alcohol to blend with the hydrocarbon liquid to form one phase. These Compositions were tested over the typical temperatures in which normal fuels are to perform and were found not to be temperature sensitive.

In each of the Compositions listed above, the Composition was found to operate satisfactorily as a fuel.

Fork Lift Engine

A 4 cylinder Yale Forklift (Model GDP 050 RUAS) with a 44 HP (2400 rpm) Mazda XA series diesel motor engine was tested under typical warehouse operating conditions on Composition No 23. As well as no difference being noted in the efficiency of the forklift engine, the use of the Composition was more likely to be more acceptable in the enclosed warehouse atmosphere.

In respect of each of the above Compositions (1, 4, 5, 6, 7, 9–20, 22 and 23), a fuel additive composition can be formed of the higher molecular weight organic alcohol and the immiscible alcohol.

Fuel Additive Compositions

The Additive Composition is illustrated by the following non-limiting examples. The following is a non-limiting example of a process to produce Additive Composition 1 below according to the invention.

Ethanol (87.0 ml) is placed in a 100 ml bottle at ambient temperature and pressure. Oleyl alcohol (13.0 ml) is added to the bottle to form a clear Additive Composition 1. Additive Composition 1 (23 ml) is then added to diesel oil (77 ml), a stopper applied to the top of the bottle and the resultant mixture is shaken for a period of approximately 30 seconds or less or for the period of time to allow proper mixing of the liquids to take place and a single phase to form.

Substantially the same method is used to produce other Additive Compositions as detailed below.

Additive Compositions were made (as percentages v—v) as follows:

| Additive Composition 1 | |
|---|---|
| Ethanol | 87 |
| Oleyl Alcohol | 13 |
| | 100 |

Additive Composition 1 (23 ml) was added to diesel oil (77 ml).

| Additive Composition 2 | |
|---|---|
| Ethanol | 87 |
| 2 Ethyl Hexanol | 13 |
| | 100 |

Additive Composition 2 (23 ml) was added to diesel oil (77 ml).

| Additive Composition 3 | |
|---|---|
| Ethanol | 83.3 |
| n-Butanol | 16.7 |
| | 100.0 |

Additive Composition 3 (6 ml) was added to diesel oil (94 ml).

| Additive Composition 4 | |
|---|---|
| Ethanol | 96.2 |
| Oleyl Alcohol | 3.8 |
| | 100.0 |

Additive Composition 4 (5.2 ml) was added to diesel oil (94.8 ml).

| Additive Composition 5 | |
|---|---|
| Ethanol | 50 |
| n-Butanol | 50 |
| | 100 |

Additive Composition 5 (20 nil) was added to diesel oil (80 ml).

| Additive Composition 6 | |
|---|---|
| Ethanol | 50 |
| n-Butanol | 25 |
| Iso-Octanol | 25 |
| | 100.0 |

Additive Composition 6 (10 ml) was added to diesel oil (90 ml).

The resultant mixtures were allowed to stand to allow the contents to settle. All of the resultant mixtures had a single phase throughout the typical temperature range in which normal fuels are to perform and were found not to be temperature sensitive.

We claim:

1. A miscible fuel blend composition consisting of diesel fuel oil and a $C_3$ (excluding n-propanol)-$C_{32}$ organic alcohol.

2. A miscible fuel blend composition according to claim 1, wherein the alcohol content does not exceed 60% by volume of the total composition.

3. A miscible fuel blend composition according to claim 1, wherein the alcohol content is between 10% and 20% by volume of the total composition.

4. A miscible fuel blend composition according to claim 1, wherein the $C_3$ (excluding n-propanol)-$C_{22}$ organic alcohol is selected from iso-propanol, butanol, iso-butanol, tert-butanol, 2 ethyl hexanol, iso-octanol, decanol, oleyl alcohol or mixtures thereof.

5. A miscible fuel blend composition according to claim 1, wherein the hydrocarbon liquid component is at least 40% by volume of the total composition.

6. A miscible fuel blend composition according to claim 1, wherein the hydrocarbon liquid component is up to 80% by volume of the total composition.

7. A miscible fuel blend composition according to claim 1, wherein the hydrocarbon liquid component is up to 95% by volume of the total composition.

* * * * *